United States Patent [19]

Cooper

[11] Patent Number: 4,656,766

[45] Date of Patent: Apr. 14, 1987

[54] MODULAR DISPLAY SYSTEM

[76] Inventor: Donald S. Cooper, 221 Ridge Rd., Scotia, N.Y. 12302

[21] Appl. No.: 762,622

[22] Filed: Aug. 5, 1985

[51] Int. Cl.[4] ..... G09F 7/00

[52] U.S. Cl. ..... 40/605; 40/611; 40/606; 40/607; 52/38; 403/231

[58] Field of Search ..... 40/605, 152, 607, 606, 40/611; 403/231; 52/38, 109, 646, DIG. 4, DIG. 13

[56] References Cited

U.S. PATENT DOCUMENTS

| | | | |
|---|---|---|---|
| 2,914,872 | 1/1959 | Goodrich | 40/605 |
| 3,466,777 | 9/1969 | Wistrand et al. | 40/605 |
| 3,571,999 | 3/1971 | Downing | 52/38 X |
| 3,659,365 | 5/1972 | Eaton | 40/611 X |
| 3,852,901 | 12/1974 | Woodle et al. | 40/605 |
| 4,001,987 | 1/1977 | Coulthard | 40/605 |
| 4,115,938 | 9/1978 | Belmuth et al. | 40/152 |
| 4,166,332 | 9/1979 | Donovan | 40/605 |
| 4,209,927 | 7/1980 | Donatelle | 40/607 |
| 4,240,765 | 12/1980 | Offterdinger | 40/152 X |
| 4,302,987 | 1/1981 | Deckys | 40/605 |
| 4,334,374 | 6/1982 | Spamer et al. | 40/606 |
| 4,430,835 | 2/1984 | Ericson | 52/DIG. 13 X |
| 4,471,548 | 9/1984 | Goudie | 40/610 |
| 4,545,142 | 10/1985 | Whisnant | 40/605 |

*Primary Examiner*—Gene Mancene
*Assistant Examiner*—J. Hakomaki
*Attorney, Agent, or Firm*—Joseph V. Claeys; Joseph C. Sullivan

[57] ABSTRACT

Describes a modular display system which includes a plurality of side members and a base portion for each of the side members. A support surface is formed on each of the base portions and a pair of spaced parallel legs are associated with each such side member and project at right angles to its respective support surface providing a channel therebetween. Also provided are a plurality of bracket members, each of which has a portion thereof within the channel of adjacent side members. Fasteners are further provided for maintaining the bracket members within respective channels whereby the side members are interconnected.

8 Claims, 7 Drawing Figures

MODULAR DISPLAY SYSTEM

BACKGROUND OF THE INVENTION

An important aspect of merchandising whether it be product or ideas is to convey information with respect thereto in a clear, accurate and complete manner. Various display systems are available for this purpose. Some are provided for point of sale display, some are provided for informational display at trade shows or the like. Modular display systems of various types are quite popular today in that they can be used for multiple purposes. For such a system to be useful it must be capable of quick and easy assembly and disassembly with a minimum of effort by non-skilled personnel and without requiring special tools.

SUMMARY OF THE INVENTION

This invention relates to a functionally and structurally improved panel display system. The system provides three dimensional viewing, may be adjusted to display information to maximum advantage, and will readily permit of the changing of the display from day to day or otherwise.

Another feature of the subject system is that is is versatile in that goods can be displayed in different ways on different occasions with a variety of presentations available within the limitations of the imagination of the displayer.

Still another object is that of providing a panel display device which may be amplified or diminished, and in which the several components will, in effect, be rigid as to each other, so that undesired relative movement of the parts is avoided.

Still another object of the invention is that of designing an assembly of this type which includes relatively few parts, each simple and rugged in construction and capable of quantity production.

The subject invention provides a system in which there is no visible hardware, easy to set up, easy mounting of graphics or products and which incorporates a unique interlocking system for durability and dependability. It can be assembled and disassembled by unskilled personnel, without the use of special tools. It is versatile so that each user can create an individual display.

DETAILED DESCRIPTION OF THE INVENTION

Figure 1:
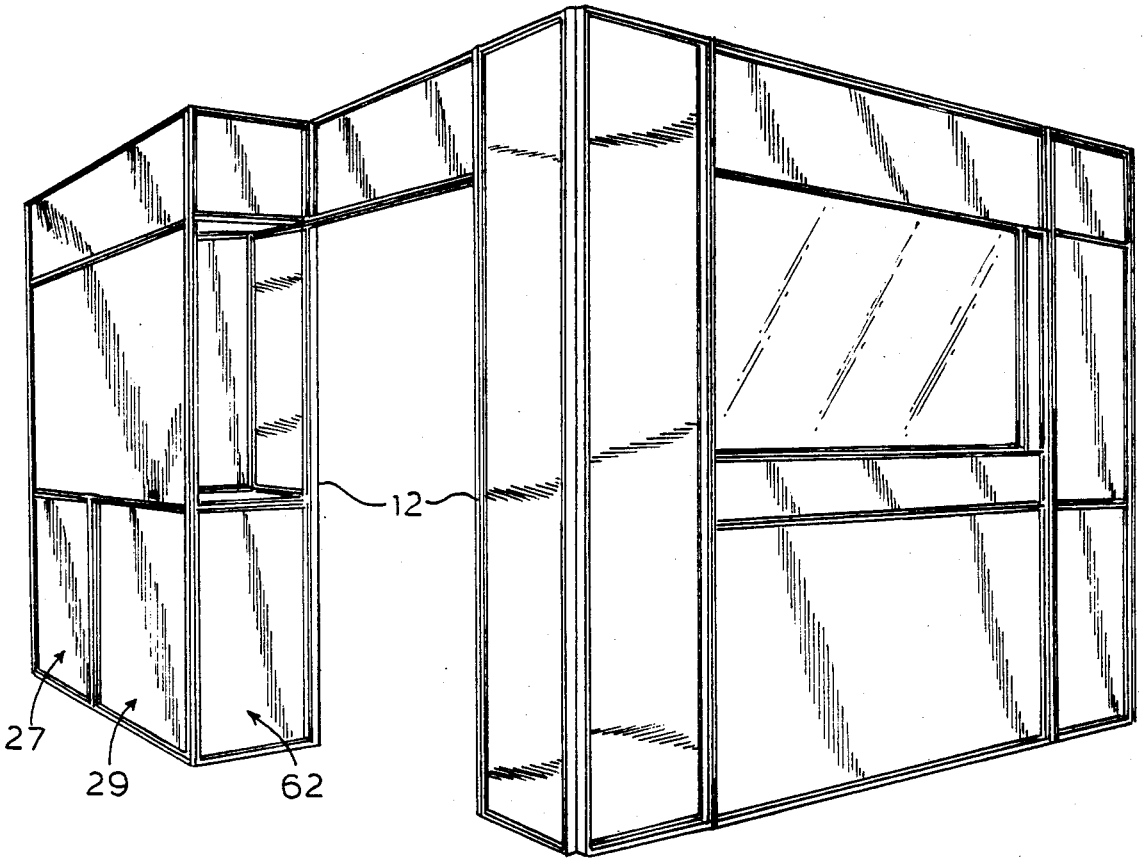
FIG. 1 is a front perspective view of a display illustrating one assembly utilizing the modular system of this invention.

The modular display system of this invention includes a frame 10 which in one embodiment of the invention is comprised of aluminum extrusion members 12. Each member 12 has a rectangular base portion 14 from which two spaced flat parallel legs 16 and 18 project at right angles to flat surface 20 to form a double "T" profile that creates a narrow channel 22 perpendicular to surface 20. A plurality of rectangular slots 24 are formed in portion 14 to provide therewith an accurate alignment for bed hook connector 26 for section to section connection such as, for example, the section containing panel 27 to the section containing panel 29 in FIG. 1.

Figure 7:
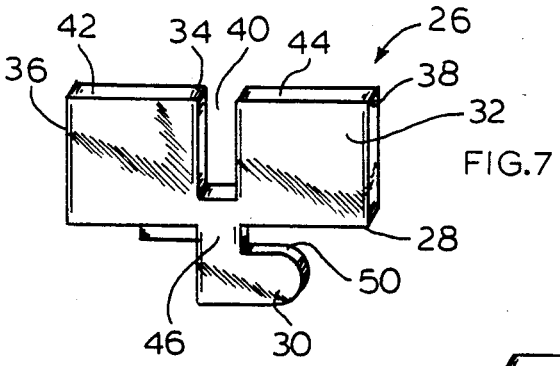
FIG. 7 is a front perspective view of a straight bed-hook connector utilized in the display in FIG. 3.

Bed hook connector 26 is shown in perspective in FIG. 7. It is formed with a flat lower surface 28 which is designed to abut surface 20 at base 14 when hook portion 30 of connector 26 is projected through rectangular opening 24 in the assembly. Depending extension 31 is provided, as shown in FIG. 7, to stabilize the hook portion in the opening 24. Connector 26 also has parallel flat front and rear surfaces 32 and 34, parallel flat end surfaces 36 and 38 and a top surface through which channel 40 is formed resulting in two flat upper surfaces 42 and 44 which are in the same plane which is parallel to the lower surface 28. The width of connector 26, measured from surface 32 to 34 and the spacing of legs 16 and 18 is such that these surfaces abut the inner face surfaces of legs 16 and 18 which form the sides of channel 22 and neck portion 46 of hook 30 abuts the facing long sides of slot 24.

Figure 2:
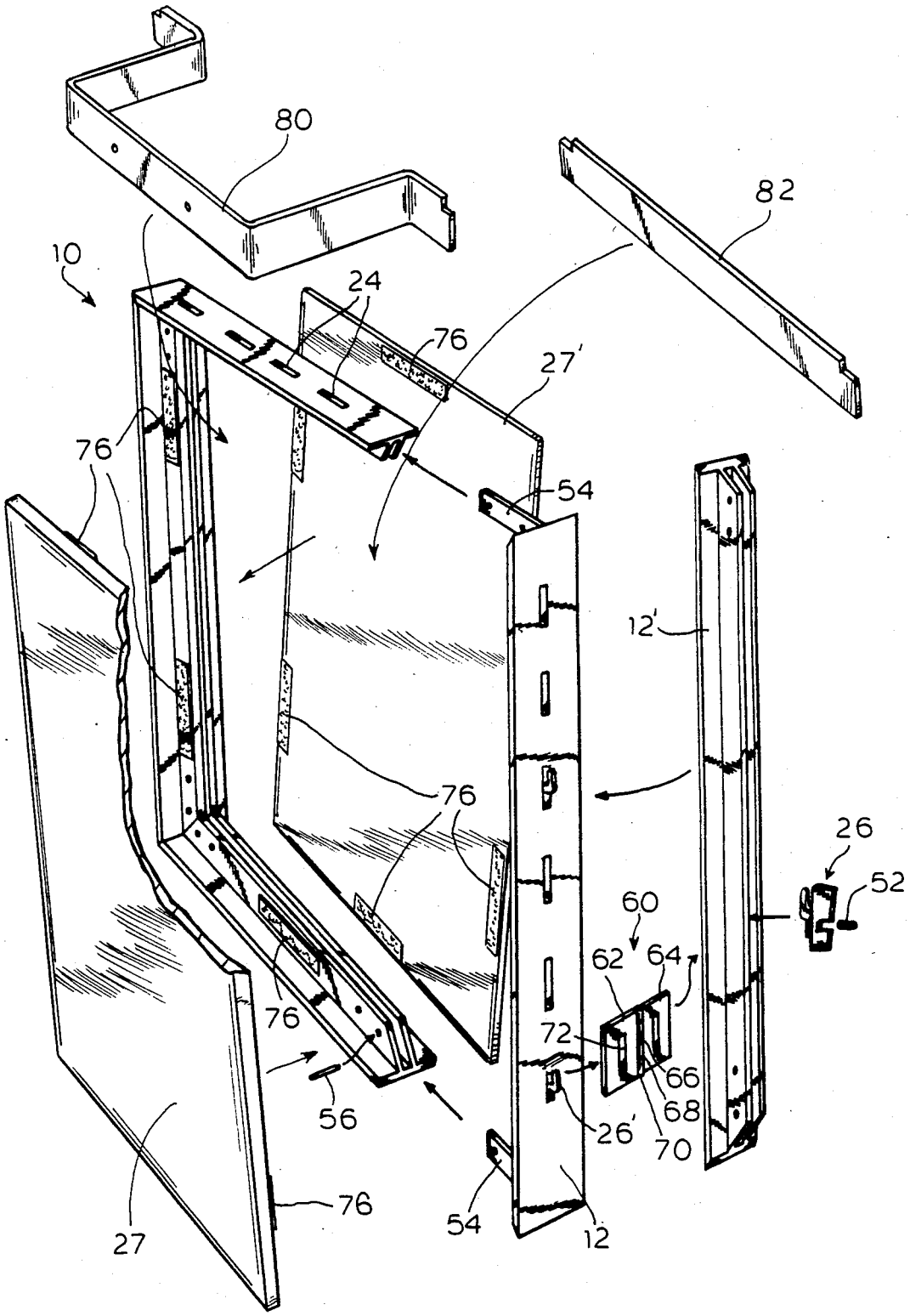
FIG. 2 is an exploded front perspective view of the display frame of the system shown in FIG. 1.

The depth of base member 14 as measured from inner surface 20 to outer surface 48 is such that surface 28 of connector 26 and upper surface 50 of hook portion 30 can abut surfaces 20 and 48 respectively to connect two members 12 together in abutting face to face relationship, by multiple hooks 30 as shown in the Figures such as, for example, in FIG. 2 where facing similar members 12 and 12' are shown. Screw fastener 52 is an optional feature, useful for insuring that the connector 26 will remain in position.

Thus, the slots 24 and hooks 26 provide means to connect adjacent frames 10.

Figure 6:
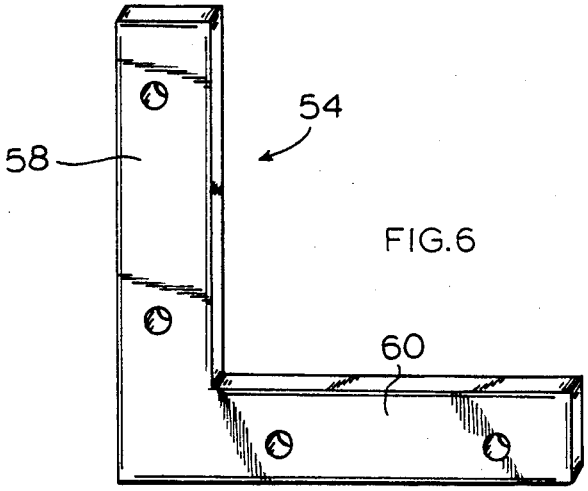
FIG. 6 is a front perspective view of a flat corner bracket utilized in FIG. 3.
Figure 3:
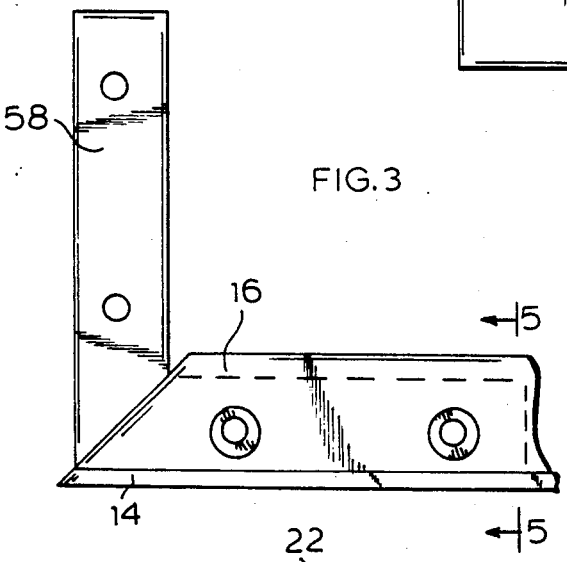
FIG. 3 is a broken segmentary view from the front of a frame side of the system shown in FIG. 1 illustrating a right angular connection of the frame sides to a corner bracket.
Figure 4:
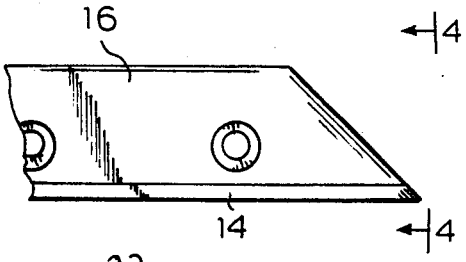
FIG. 4 is an end view of the frame side taken in the direction of the arrows 4—4 in FIG. 3 illustrating the profile thereof.
Figure 4:
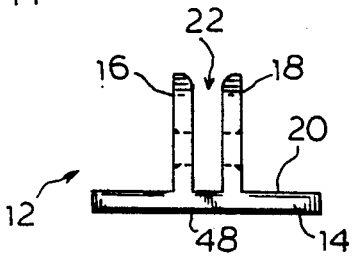
Figure 5:
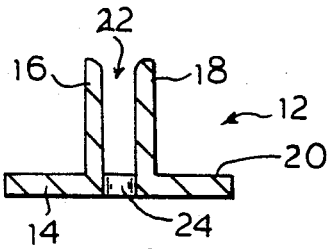
FIG. 5 is a sectional view taken along the line 5—5 in the direction of the arrows in FIG. 3.

Each frame in turn has been formed by four members 12 connected in the configuration of a rectangle. Corner brackets 54 are provided, together with screw fasteners 56 to fasten the mitered corners of adjacent members 12 to maintain such members 12 together at right angles as shown in FIG. 2. Corner bracket 54 is shown in enlarged perspective view in FIG. 6. Legs 16 and 18 provide sideways support to the legs 58 and 60 of the bracket 54 which are projected into channel 22. This creates the corner attachement for adjacent extrusions 12.

The double "T" configuration is very strong structurally and provides a minimum number of surfaces and strong support. The heights of each leg of bracket 54 and connector 26 is, in the embodiment shown, the same as that of the legs 16 and 18.

A hinge member 60 is provided to provide for the connection of adjacent frames 10 in angular relationship such as for example, as are connected the frames or sections containing panels 29 and 62' as shown in FIG. 1.

Hinge 60 comprises members 62 and 64 which are provided with cylindrical edges 66 and 68 which can be aligned on their longitudinal axis for joining by pin 70 inserted therein. Each of the hinge halves 62 and 64 has a rectangular slot formed therein for engagement with a bed hook connector attached to a respective member 12 as shown in FIG. 2 where slot 72 engages hook 26' in extrusion 12 and slot 76 engages hook 26 when it is inserted in extrusion 12'.

Thus adjacent frames can be connected in angular relationship by a plurality of hooks 26. Use of this connection method gives the user essentially 360 degree movement capability panel to panel. It creates both a "right" and "left" hinge by simply reversing the connector 60 one hundred eighty degrees and reconnecting it to an extrusion 12.

Members 12 provide a recessed surface for attachment and removal of insert display panels such as 27 and 27' shown in FIG. 2. The parallel legs which project from the base portion 14 are located upon the surface thereof in spaced relation to at least one edge 13 of the member to provide a support surface 15 between the legs and edge 13 to support a panel 27 theron. The panels can be of assorted materials and varying thicknesses on the front and/or back. Attachment of the insert displays can be by substantially any fastening arrangement. In the embodiment of FIG. 2 velcro tape 76 is provided on both the members 12 and the insert display as attachment means.

Additionally, if desired panels can be inserted by removing an extrusion 12 from a frame and sliding a panel into the "T" slot and refastening the member 12 to complete the perimeter.

The slots 24 in the members 12 create a retaining configuration that allows brackets to be mounted within a formed panel perimeter and act as support or supports for lights, displayed products and other desired purposes. A typical light fixture bracket 80 and product support bracket 82 are shown in position in FIG. 2.

In summary therefore the main components of the assembly are:

member 12 which provides the frame periphery;

corner bracket 54 which is sized to afford a secure fit within the "T" channel of member 12;

bed hook connector 26 which is a simple piece that is easy to mold, very strong, and is precisely positioned within the "T" channel as it is dropped into the connector slot allowing for very close tolerances in assembly to be easily achieved, resulting in a very rigid assembly of adjacent display panels without the need for hooks; and the hinge connector 60.

Thus, there is created a unique display structure that is lightweight, rigid, flexible and aesthetically attractive.

I claim:

1. A modular panel display system including in combination a plurality of side members, a frame defined by respective side members, a base portion of each of said side members, a first surface of each said base portion, a pair of spaced parallel legs projecting inwardly of said frame at right angles to its respective first surface, inner and outer surfaces of said legs, said inner surfaces of respective legs facing one another and providing a channel therebetween, said legs located upon said first surface in spaced relation to at least one edge of said respective side member to provide a support surface between said respective outer surface of at least one of said legs and said edge to support a panel thereon, a plurality of bracket members, each of said bracket members having a portion thereof within the channel of adjacent side members, and fastening means maintaining said bracket members within respective channels whereby said side members are interconnected.

2. A modular display system in accordance with claim 1 including a display panel and in which said bracket members interconnect respective side members at the ends thereof to provide a peripheral frame for said display panel and fastening means are provided on said legs for fastening said display panel thereto.

3. A modular display system in accordance with claim 1 including an outer surface of each said side member, a plurality of slots formed in each said base portion between respective parallel legs, and a hook portion of each bracket member projecting through a respective slot to interconnect respective side members with respective outer surfaces in abutment.

4. A modular display system in accordance with claim 1 in which a plurality of slots are formed in each said base portion between respective parallel legs and in which a mounting bracket is provided, said bracket having end means disposed within a respective channel and respective slot for supporting the same.

5. A modular display system in accordance with claim 1 including an outer surface of each said side member, a plurality of slots formed in each said base portion between respective parallel legs, a hook portion of each bracket member projecting through a respective slot, a second-bracket, a first surface of said second-bracket and a first second-bracket slot formed in said first surface for receipt of a respective hook portion to maintain said first surface in abutment with a respective outer surface.

6. A modular display system in accordance with claim 5 in which said second-bracket is provided with a second surface angularly disposed with said first surface, a second second-bracket slot formed in said second surface for receipt of a respective hook portion to maintain said second surface in abutment with a respective outer surface.

7. A modular display system in accordance with claim 6 in which said first and second surfaces of said second-bracket are pivotally interconnected.

8. A modular display system including in combination a plurality of side members, a frame defined by respective side members, a base portion of each of said side members, a first surface of each said base portion, a pair of spaced parallel legs projecting inwardly of said frame at right angles to its respective first surface, inner and outer surfaces of said legs, said inner surfaces of respective legs facing one another and providing a channel therebetween, said legs located upon said first surface in spaced relation to at least one edge of said respective side member to provide a support surface between said respective outer surface of at least one of said legs and said edge to support a panel thereon, a plurality of first-bracket members, each of said first-bracket members having a portion thereof within the channel of adjacent side members, fastening means for maintaining said first-bracket members within respective channels whereby a peripheral frame is formed, an outer surface of each said side member, a plurality of slots formed in each said base portion between respective parallel legs, a plurality of second-bracket members, a hook portion of each said second-bracket member projecting through a respective slot to interconnect said peripheral frame with a like peripheral frame with respective outer surfaces of respective side members in abutment.

* * * * *